US006170364B1

(12) United States Patent
Johnson

(10) Patent No.: US 6,170,364 B1
(45) Date of Patent: Jan. 9, 2001

(54) SOFT GOLF SPIKE UTILITY TOOL

(76) Inventor: Neil Johnson, 108 Woodcliff Ct., Springdale, AR (US) 72764

( * ) Notice: Under 35 U.S.C. 154(b), the term of this patent shall be extended for 0 days.

(21) Appl. No.: 09/358,758

(22) Filed: Jul. 22, 1999

Related U.S. Application Data

(63) Continuation-in-part of application No. 08/940,126, filed on Oct. 1, 1997, now abandoned.

(51) Int. Cl.[7] ..... B25B 13/56
(52) U.S. Cl. ..... 81/176.1; 81/3.48; 81/120
(58) Field of Search ..... 81/3.48, 120, 176.1, 81/176.15

(56) References Cited

U.S. PATENT DOCUMENTS

| | | | |
|---|---|---|---|
| D. 306,471 | 3/1990 | Gabbert, Jr. | D21/234 |
| D. 343,558 | 1/1994 | Latraverse et al. | D8/21 |
| D. 353,315 | 12/1994 | Romeo | D8/70 |
| D. 356,016 | 3/1995 | Jewell | D8/21 |
| D. 359,335 | 6/1995 | Cartwright | D21/234 |
| D. 359,895 | 7/1995 | Snow | D8/21 |
| 1,518,222 | 12/1924 | Sather | 81/3.48 |
| 2,525,222 | 10/1950 | Holt | 81/90 |
| 2,881,648 | 4/1959 | Hottle | 81/90 |
| 4,262,562 | 4/1981 | MacNeill | 81/90 C |
| 4,480,514 | 11/1984 | Ponziani | 81/461 |
| 4,679,468 | 7/1987 | Gray | 81/121.1 |
| 5,048,138 | 9/1991 | Everroad | 7/138 |
| 5,146,813 | 9/1992 | Stanfill, Jr. | 81/120 |
| 5,272,943 | 12/1993 | Edwards | 81/461 |
| 5,284,072 | 2/1994 | Smith | 81/63 |
| 5,400,680 | 3/1995 | Spangler | 81/176.15 |

*Primary Examiner*—James G. Smith
(74) *Attorney, Agent, or Firm*—Head, Johnson & Kachigian

(57) ABSTRACT

A golf shoe spike tool used for installing or removing golf spikes made of polyurethane or similar material. The tool has a handle, a head and shaft between the head and handle. The head has a plurality of teeth with engage a spike. Through rotational force, the spike is installed or removed from a golf.

9 Claims, 2 Drawing Sheets

SOFT GOLF SPIKE UTILITY TOOL

REFERENCE TO PENDING APPLICATIONS

This application is a continuation-in-part application of application Ser. No. 08/940,126, filed Oct. 1, 1997, and entitled "Soft Spike Utility Tool" abandoned.

REFERENCE TO MICROFICHE APPENDIX

This application is not referenced in any microfiche appendix.

BACKGROUND OF THE INVENTION

1. Field of the Invention

The present invention relates to a securing tool used for removing or installing golf spike made of soft polyurethane or other rubber material.

2. Prior Art

For years, metal spikes have been attached to golf shoes in order to assist the user with traction on the golf course. Special tools have been developed in order to assist in the installation and removal of these spikes.

U.S. Pat. No. 2,525,222 issued to Holt which discloses a tool for such a purpose. This tool includes a handle, a shaft connected to the handle at one end and having a head portion connected to the other end of the shaft. The outer portion of the head portion is recessed in order to receive a golf spike or cleat. The head portion also includes two pins protruding beyond the outer surface of the head. These pins were fitted into corresponding recesses within the spike in order to gain traction in order to rotate the spike into or out of the sole of the golf shoe. Due to the spikes being constructed of a metal material, the pins are a necessity.

Many other designs for golf spike tools have been disclosed. See U.S. Pat. Nos. 2,881,884; 4,679,468; 5,048,138; 5,272,943; 5,284,072; 5,400,680. While all the prior art patents modify the '222 Patent, and disclose different methods and apparatuses for securing golf spikes, they all have a common feature, that being, they are designed for use with metal spikes by utilizing securing pins to rotate a target spike.

In recent years, a new type of spike has been developed out of polyurethane or similar material. Because this type of spike causes less damage to golf course and golf facilities, they are becoming more and more popular to use. With the increase of use, multiple designs are being created, with and without recesses for securing pins. Since the prior art relies upon securing pins to rotate a target spike, these prior art tools are not suited for use with these new spikes. Thus, there is a need for a golf spike tool designed specifically for use with golf spikes made of polyurethane or similar material.

SUMMARY OF THE INVENTION

The present invention is directed toward a securing tool used for removing or installing golf spike made of soft polyurethane or other rubber material. The invention generally comprises a handle, a shaft having a first end and a second end, and a head.

The handle is connected to the first end of the shaft. It can be removably connected for ease of storage. Through the handle, rotational force which rotates the target spike is applied.

The head is connected to the second end of the shaft. It can be removably connected for ease of storage. The head has a body which defines a spike engaging end and a shaft engaging end. The shaft engaging end interfits with the second end of the shaft. The spike engaging end is recessed to form a recessed portion having a lip having an outer edge and a recessed surface.

A plurality of teeth, each having a mounting end and spike engaging prongs at the other end, are utilized to provide traction to a target spike. The mounting end of each tooth is pivotally mounted with the head. The prongs extend outward from the spike engaging end of the head beyond the recessed surface.

In operation, a target spike is placed within the recessed portion. The spike engaging prongs of the teeth secure the spike by slightly penetrating its surface. Rotational force is applied to the handle, causing the tool to rotate. The spike, by being secured by the prongs, rotates along with the tool.

The primary objective of the present invention is to provide an apparatus embodying simple effective means for inserting or removing a golf spike.

Another objective of the present invention is to provide an golf tool apparatus which can be utilized with golf spikes of a polyurethane or similar material.

Another objective of the present invention is to provide an apparatus which can be easily portable and storable.

DETAILED DESCRIPTION OF THE PREFERRED EMBODIMENTS

Figure 1:
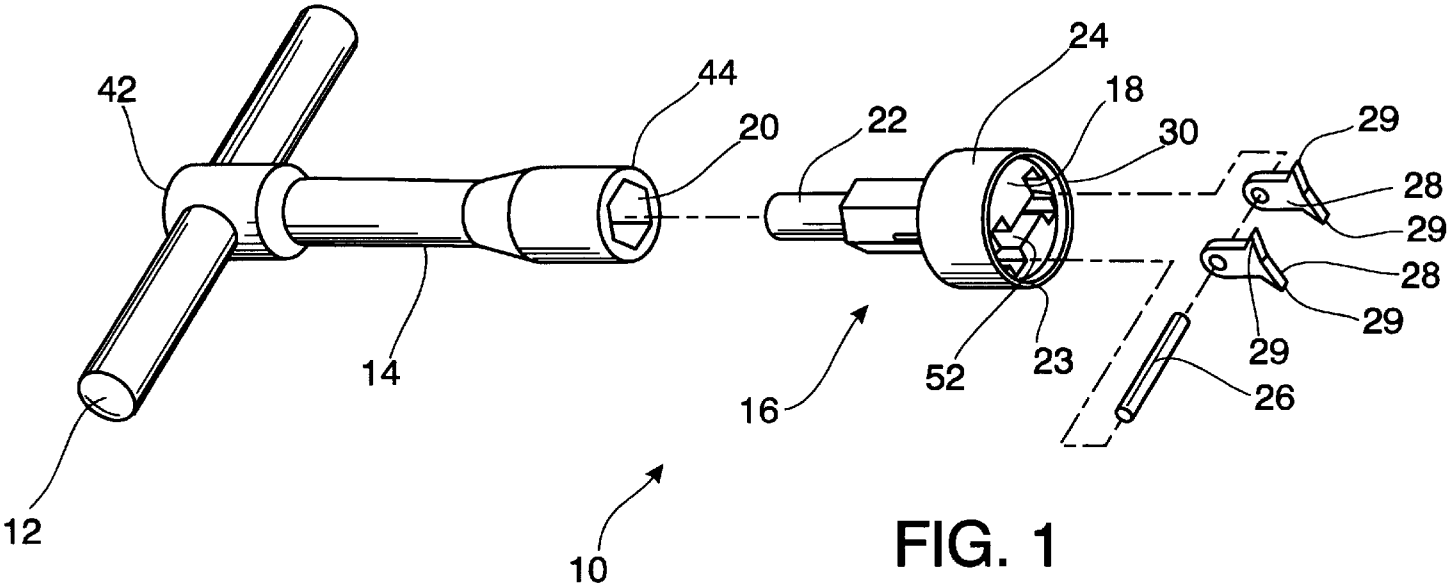
FIG. 1 is an exploded perspective view of the present invention.
Figure 3:
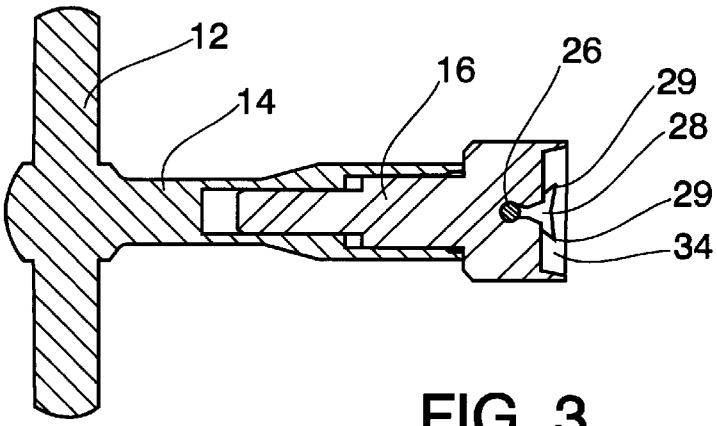
FIG. 3 is a cross-sectional view of the present invention.

As shown in the figures, the preferred embodiment of the present invention discloses a golf spike tool 10 comprising generally a handle 12, a shaft 14 and a head 16. Shaft 14 has a first end 42 and a second end 44. First end 42 is connected to handle 12. Second end 44 has an opening 20.

Head 16 comprises a body 24 having a spike engaging end 23 and a shaft engaging end 22. Body 24 can be in a cylindrical shape. Shaft engaging end 22 can be removably connected within opening 20 of shaft 14.

Spike engagement end 23 has a recessed surface 18 and a lip 30, wherein said recessed surface has a cavity 52 and lip 30 has an edge 31. Recessed surface 18 and lip 30 form recessed portion 34.

A plurality of teeth 28 are pivotally mounted by pin 26 within cavity 52. Each tooth has a plurality of prongs 29 extending outward from recessed surface 18 but do not extend past edge 31.

Figure 2:
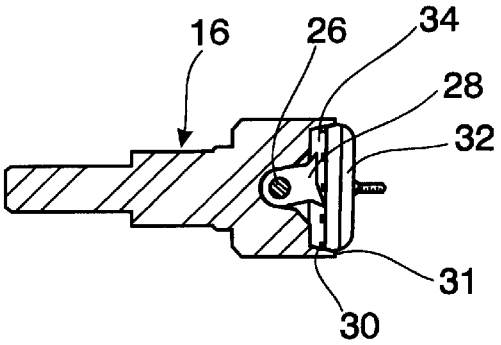
FIG. 2 is a cross-sectional view of the head portion of the present invention.
Figure 8:
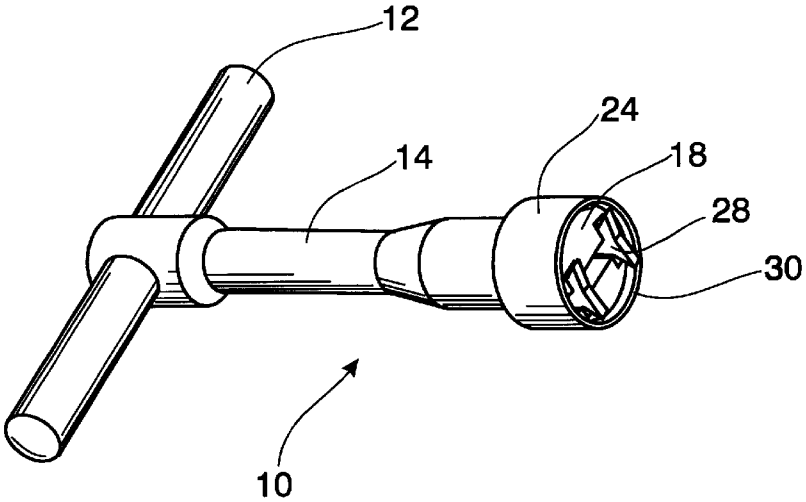
FIG. 8 is a perspective view of the present invention.
Figure 4:
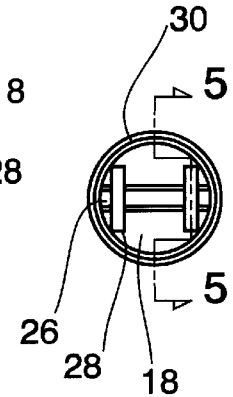
FIG. 4 is a bottom view of the head portion of the present invention.
Figure 5:
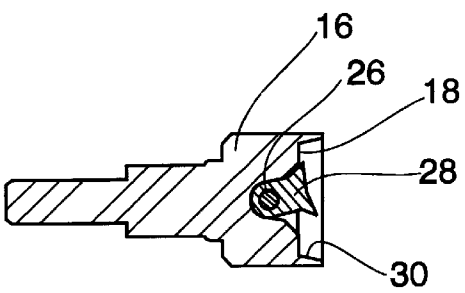
FIG. 5 is a cross-sectional view of FIG. 4 along line A—A.
Figure 6:
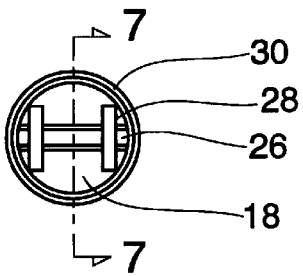
FIG. 6 is a bottom view of the head portion of the present invention.
Figure 7:
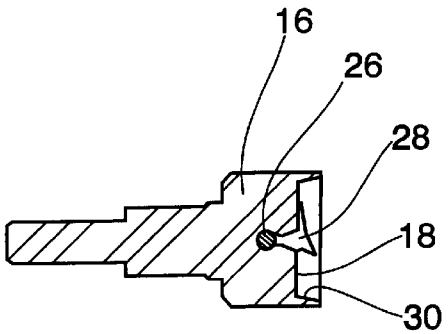
FIG. 7 is a cross-sectional view of FIG. 6 along line B—B.

In operation, as shown in FIG. 2, a soft spike 32, which can be made of polyurethane rubber or the like material is placed within recess 34. When rotational force is applied to tool 10, prongs 29 engages spike 32. Spike 32 is then rotated in the desired direction.

Whereas, the present invention has been described in relation to the drawings attached hereto, it should be understood that other and further modifications, apart from those shown or suggested herein, may be made within the spirit and scope of this invention.

What is claimed is:

1. A golf spike tool to be used in conjunction with shoe spikes made of resilient rubber material, said tool comprising:

a shaft having a first end and a second end, said second end having an opening therein;

a handle in communication with said first end of said shaft;

a head having a body having a shaft engaging end and a spike engaging end, said shaft engaging end being in communication with said second end of said shaft, said spike engaging end having a recessed surface and a lip to form a recessed portion, wherein said recessed surface has a cavity, where in said lip has an edge; and a plurality of teeth, wherein each tooth having a plurality of prongs, said teeth pivotally secured within said cavity.

2. The tool of claim 1 wherein said body of said head is further defined as being cylindrical.

3. The tool of claim 1 wherein said shaft engaging end of said head is in connection with said opening of said second end of said shaft.

4. The tool of claim 1 wherein said resilient rubber material is polyurethane.

5. The tool of claim 1 wherein said tool is to be used with golf shoes.

6. The tool of claim 1 wherein said teeth are secured within said cavity wherein said prongs extend outward from said recessed surface but do not extend past said edge.

7. The tool of claim 1 wherein said shaft engaging end of said head being further defined as by removably connected within said opening of said shaft.

8. The tool of claim 1 wherein said handle is further defined as being removably connected to said first end of said shaft.

9. A golf spike tool to be used in conjunction with golf shoe spikes made of polyurethane material, said tool comprising:

a shaft having a first end and a second end, said second end having an opening therein;

a handle removably connected with said first end of said shaft;

a head having a cylindrical body having a shaft engaging end and a spike engaging end, said shaft engaging end being removably connected to said opening of said second end of said shaft, said spike engaging end having at recessed surface and a lip to form a recessed portion, wherein said recessed surface has a cavity, where in said lip has an edge; and a plurality of teeth, wherein each tooth having a plurality of prongs, said teeth are pivotally secured within said cavity and extend outward front said recessed surface but do not extend past said edge.

* * * * *